US011654474B2

(12) United States Patent
Jung et al.

(10) Patent No.: US 11,654,474 B2
(45) Date of Patent: May 23, 2023

(54) WIRE FEEDING UNIT AND WIRE BENDING APPARATUS INCLUDING THE SAME

(71) Applicants: Youn Ho Jung, Seoul (KR); Jae Woong Jung, Seoul (KR)

(72) Inventors: Youn Ho Jung, Seoul (KR); Jae Woong Jung, Seoul (KR); Yoon Sang Shin, Seoul (KR)

(73) Assignees: Youn Ho Jung, Seoul (KR); Jae Woong Jung, Seoul (KR)

( * ) Notice: Subject to any disclaimer, the term of this patent is extended or adjusted under 35 U.S.C. 154(b) by 0 days.

(21) Appl. No.: 16/401,394

(22) Filed: May 2, 2019

(65) Prior Publication Data

US 2020/0346276 A1 Nov. 5, 2020

(51) Int. Cl.
*B21F 23/00* (2006.01)
*B21F 1/02* (2006.01)

(52) U.S. Cl.
CPC ..... *B21F 23/00* (2013.01); *B21F 1/02* (2013.01)

(58) Field of Classification Search
CPC .... B21F 1/00; B21F 1/02; B21F 1/023; B21F 23/00; B21F 23/005; B21D 43/006; B21D 43/12; B21D 43/04; B21D 43/02; B21D 43/08; B65H 51/105; B65H 51/14
USPC ..... 72/419; 226/170
See application file for complete search history.

(56) References Cited

U.S. PATENT DOCUMENTS 5,060,395 A * 10/1991 Pepin ..... G01B 7/042 33/735
5,146,673 A * 9/1992 Hoffa ..... H02G 1/1256 29/33 M
5,253,555 A * 10/1993 Hoffa ..... H02G 1/1256 81/9.51
5,522,130 A * 6/1996 Wollermann ..... B26D 5/34 29/33 F
5,653,016 A * 8/1997 Hoffa ..... H02G 1/1256 29/564.4
2017/0274442 A1* 9/2017 Perry ..... B21F 1/00
2017/0321976 A1* 11/2017 Barnes ..... F28G 15/04 29/33 M

FOREIGN PATENT DOCUMENTS

CN 107324141 A * 11/2017 ..... B65H 57/12
CN 108273947 A * 7/2018 ..... B21F 23/00
CN 109230864 A * 1/2019 ..... B65H 51/14
GB 2320076 A * 6/1998 ..... F28G 1/163
KR 10-0675792 B1 1/2007

* cited by examiner

*Primary Examiner* — Debra M Sullivan
*Assistant Examiner* — Matthew Stephens
(74) *Attorney, Agent, or Firm* — The PL Law Group, PLLC

(57) ABSTRACT

A wire feeding unit includes a driving motor; a driving roller which rotates by a driving force of the driving motor; a plurality of driven rollers arranged such that outer circumferential surfaces thereof are positioned on a same line; a belt which interlocks the driving roller and the plurality of driven rollers and is brought into contact with a wire, which is drawn into a side of the driven rollers, on a side of the plurality of driven rollers; and a plurality of idlers which support the wire on a side in which the wire and the belt are in contact with each other and assist feeding of the wire along a feeding direction of the belt in a free-rotation state.

3 Claims, 4 Drawing Sheets

WIRE FEEDING UNIT AND WIRE BENDING APPARATUS INCLUDING THE SAME

BACKGROUND

1. Field

The following description relates to a wire feeding unit which supplies a wire to a bending apparatus for bending the wire and a wire bending apparatus including the wire feeding unit.

2. Description of Related Art

Generally, wire bending machines are widely used in a wide range of applications ranging from two-dimensional machining to three-dimensional shape machining owing to the advantage in that they can process quickly and inexpensively various shaped workpieces used in complicated and various types of parts, such as automobile parts, industrial machine parts, materials used in office supplies, medical supplies, construction materials, and the like, from mass production to small quantity production. A wire bending apparatus may be largely divided into a straightener for straightening a wire, a feeding device for transferring the wire, and a head portion for performing at least one of folding, bending, and cutting. The feeding device rotates while pressurizing the wire using a plurality of feeding rollers and transfers the wire of a predetermined length. At this time, there may occur a case in which the wire deviates from the belt or roller in contact with the wire along a feeding direction in the course of feeding the wire and there may be problems in that feeding power may not be transferred to the wire to be fed and the feeding power is lost due to an occurrence of slippage.

A difference between a numerical control value and an actually transferred value may be caused by deviation and slippage of a wire transferred by a controller so that bending or folding may be processed at a point in time different from a set value.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

The present disclosure is to solve problems of the above-described conventional wire feeding unit and one objective of the present disclosure is to reduce resistance to a feeding direction by limiting a configuration which is in direct contact with a wire to a belt and an idler to reduce a contact area and to prevent twisting that occurs in the course of feeding by increasing the contact area through the belt.

Another objective of one embodiment of the present disclosure is to provide a feeding power generated by one driving motor as a feeding force, wherein a wire is fed through the contact between a belt that rotates by the feeding power and a freely rotatable idler.

Still another objective of one embodiment of the present disclosure is to prevent a wire from deviating in position by forming a guide groove that allows a wire to be seated therein on an idler that is brought into contact with the wire.

In one general aspect, a wire feeding unit includes a driving motor; a driving roller which rotates by a driving force of the driving motor; a plurality of driven rollers arranged such that outer circumferential surfaces thereof are positioned on a same line; a belt which interlocks the driving roller and the plurality of driven rollers and is brought into contact with a wire, which is drawn into a side of the driven rollers, on a side of the plurality of driven rollers; and a plurality of idlers which support the wire on a side in which the wire and the belt are in contact with each other and assist feeding of the wire along a feeding direction of the belt in a free-rotation state.

Each of the plurality of idlers may have a guide groove formed on an outer circumferential surface to allow the wire to be seated therein.

The guide groove may prevent the wire from deviating in position through surface friction greater than or equal to that of a metal material.

A depth of the guide groove may be formed to be less than or equal to a radius of the wire and a surface of the guide groove may be in contact with a half of an outer circumferential surface of the wire.

The plurality of idlers may be provided and each idler may be positioned to correspond to each of the plurality of driven rollers.

The wire feeding unit may further include a cover portion having an auxiliary guide which is a groove for guiding the wire in an auxiliary manner along an arrangement of the plurality of idlers.

In another general aspect, a wire bending apparatus includes a wire inserter; a wire feeding unit which feeds a wire that is fed through the wire inserter; and a head portion which bends or folds the wire fed through the wire feeding unit, wherein the wire feeding unit comprises a driving motor, a driving roller which rotates by a driving force of the driving motor, a plurality of driven rollers arranged such that outer circumferential surfaces thereof are positioned on a same line, a belt which interlocks the driving roller and the plurality of driven rollers and is brought into contact with a wire, which is drawn into a side of the driven rollers, on a side of the plurality of driven rollers, and a plurality of idlers which support the wire on a side in which the wire and the belt are in contact with each other and assist feeding of the wire along a feeding direction of the belt in a free-rotation state.

Other features and aspects will be apparent from the following detailed description, the drawings, and the claims.

Figure 1:
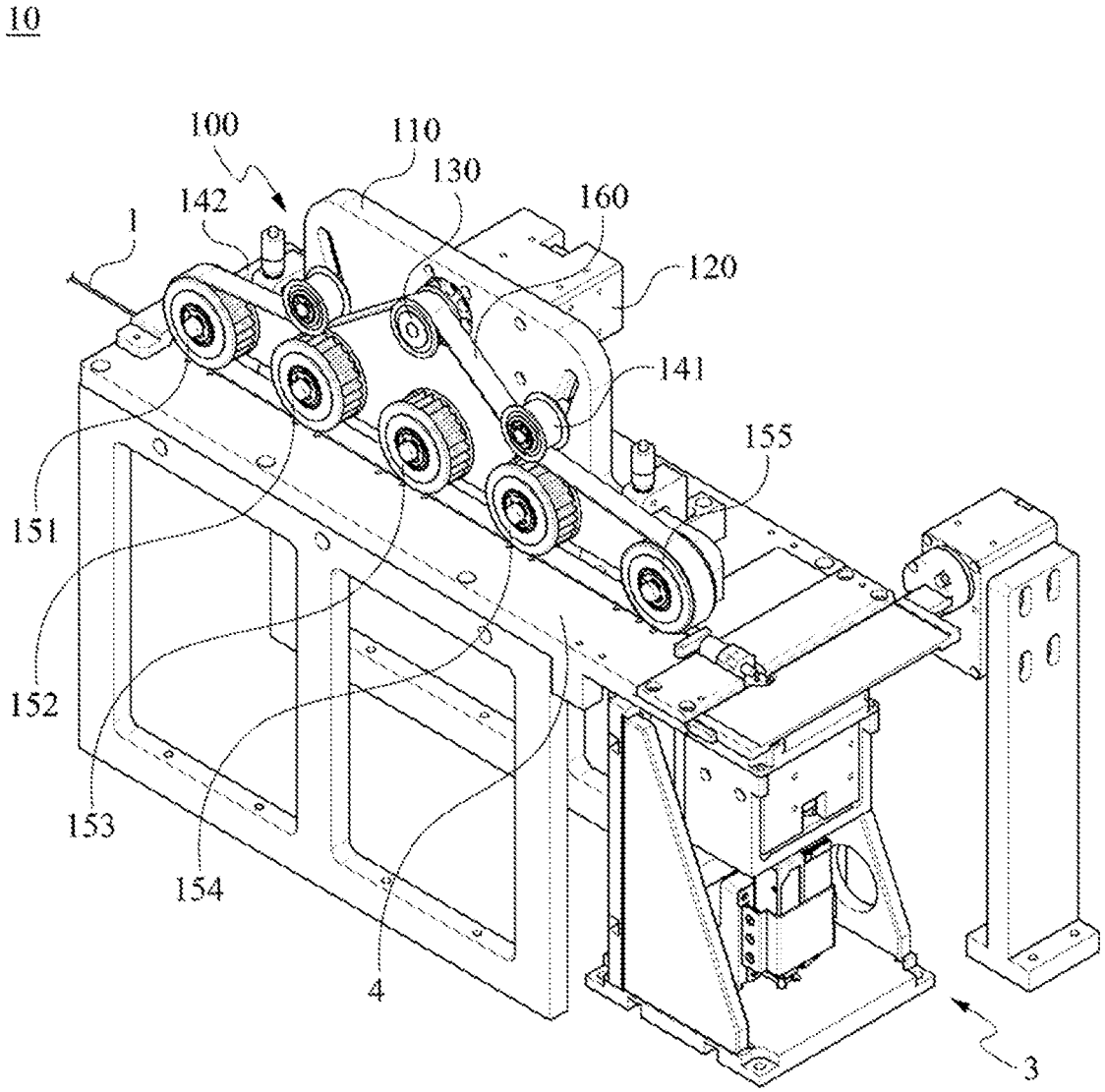
FIG. 1 is a perspective view illustrating a wire bending apparatus employing a wire feeding unit according to one embodiment of the present disclosure.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Hereinafter, specific embodiments of the present disclosure will be described in accordance with the following drawings, however, they are only exemplary embodiments of the disclosure, and the present disclosure is not limited thereto.

Descriptions of well-known functions and constructions may be omitted for increased clarity and conciseness. Also, terms described in below are selected by considering functions in the embodiment and meanings may vary depending on, for example, a user or operator's intentions or customs. Therefore, definitions of the terms should be made on the basis of the overall context.

The spirit and scope of the disclosure are defined by the appended claims. The following embodiments are only made to efficiently describe the progressive technological scope of the present disclosure to those skilled in the art.

A wire feeding unit 100 and a wire bending apparatus 10 including the wire feeding unit 100 which will be described below are merely examples and thus the present disclosure is not limited to the disclosed examples. For example, driven rollers illustrated in FIG. 1 include a first driven roller 151, a second driven roller 152, a third driven roller 153, a fourth driven roller 154, and a fifth driven roller 155. The driven rollers are not limited to the above examples, and a smaller number of driven rollers may be provided. However, in the present disclosure, a plurality of driven rollers are provided to guide a feeding direction of a wire 1. In this case, the feeding direction of the wire 1 may be from a side into which the wire 1 is drawn to a head portion 3 which bends or folds the wire 1.

In addition, the configuration of the wire bending apparatus 10 will be described with reference to the wire feeding unit 100 including characteristics of the wire bending apparatus 10.

FIG. 1 is a perspective view illustrating a wire bending apparatus 10 employing a wire feeding unit 100 according to one embodiment of the present disclosure.

Referring to FIG. 1, the wire bending apparatus 10 may include a wire inserter which is not illustrated, a wire feeding unit 100, and a head portion 3. The wire inserter feeds a wire 1 into the wire bending apparatus 10 in such a way to provide the wound wire 1. For example, the wire inserter may be formed in a shape such as a hollow pipe through which the wire 1 can be inserted and penetrate.

In addition, the head portion 3 may be configured to bend or fold the wire 1 fed by the wire feeding unit 100, which may be performed by determining a wire feeding speed, a feeding amount, and a time point of bending or folding under the control of a controller which is not illustrated.

In addition, the wire feeding unit 100 may include a driving motor 120 for generating a feeding power (driving force), a driving roller 130, driven rollers 151, 152, 153, 154 and 155, a belt 160, an idler 170, and an auxiliary roller 141 and 142. Each configuration can be fixed at the fixing plate 110 by passing there through or by not passing there through. For example, a driving motor 120 may be positioned on one surface of the fixing plate 110 and a motor shaft of the driving motor 120 may be disposed to pass through the fixing plate 110.

The motor shaft may be rotated in a form of coupling the driving roller 130 and the driving roller 130 has an outer circumferential surface to which a belt 160 is coupled, thereby rotating the belt 160. Here, the coupling may be belt-pulley coupling in which a roller and the belt 160 are coupled to each other by a side inclination or coupling between teeth (S in FIG. 2) formed on an outer circumferential surface of a roller and the belt 160 of a timing belt type. By the coupling, the driving force generated from the driving motor 120 makes the rotation speed and the feed amount of the wire 1 proportionally, so that the feed speed and the feed amount controlled by the control unit (not shown) may be realized.

The belt 160 may transfer the driving force of the driving motor 120 to the driven rollers 150 through the driving roller 130. That is, the belt 160 may interlock the driving roller 130 and the driven rollers 151, 152, 153, 154 and 155. Due to the interlocking, a rotation direction of the driven rollers 151, 152, 153, 154 and 155 may be determined according to a direction in which the driving roller 130 rotates. The rotation direction is determined as a direction in which the belt 160 is fed from a side into which the wire 1 is drawn to the head portion 3. The belt 160 may be flexible enough to be curved along outer circumferential surfaces of the primary driving roller 130 and the driven rollers 151, 152, 153, 154 and 155. The wire 1 may be contacted to an opposite surface of which teeth S are formed, which are coupled to the driving roller 130 and the driven rollers 150, and be fed in a feeding direction (M in FIG. 4).

Further, when the belt 160 is required to be installed or uninstalled due to aging or damage thereof, tension acting on the belt 160 may be released so that the belt 160 can be removed. The release of the tension may be performed by pressurization of the auxiliary roller 140. In the same manner as in the driving roller 130 and the driven rollers 151, 152, 153, 154 and 155, the auxiliary roller 140 may be in contact with an outer surface which the wire 1 is brought into contact with, rather than being in contact with an inner surface of the belt 160 where the teeth S are formed. In addition, there is no separate shape on the outer circumferential surface of the belt 160 so that it is possible that the belt 160 moves through the surface contact with the curved surface in the shape of the outer circumferential surface of the auxiliary roller 140, and that the tension is provided to the belt 160.

Specifically, a position of the auxiliary roller 140 may be selectively determined within a length of a slot hole formed in the fixing plate 110. Accordingly, the position of the auxiliary roller 140 within the length of the slot hole may cause tension to be formed or released on the belt 160. The belt 160 may be fed by the rotation of the driving roller 130 in a state in which the tension is formed, and the removal or the belt 160 may be performed in a state in which the tension is released. A position at which the auxiliary roller 140 is placed within the length can be selectively determined, and thereby it is possible to adjust the tension.

As described in the example of the present disclosure, the wire feeding apparatus 100 includes a plurality of driven rollers 151, 152, 153, 154 and 155. There may be two or more points at which at least two driven rollers 151, 152, 153, 154 and 155 pressurize the wire 1 through the belt 160, and an arbitrary direction formed by connecting the points may be a direction in which the wire 1 is guided. Therefore, a plurality of driven rollers 151, 152, 153, 154 and 155 have to be provided to form directionality.

Further, since the belt 160 is fed along the outer circumferential surfaces of the driven rollers 151, 152, 153, 154 and 155 and the driving roller 130, the belt 160 may have flexibility. The surface friction formed between wire 1 and belt 160 having a predetermined level of softness may have at least one surface with a relatively high surface friction compared to between metal materials and wire 1 due to the softness, which may be a factor that can prevent slippage with the wire 1 in the course of contacting for feeding the wire 1. Since the wire 1 is in the form of a fine wire, there is a limit in structurally increasing a contact area with the belt 160, and thus the surface friction may be increased through a property of matter (softness).

By increasing the surface friction, a contactable surface area of between the wire 1 and the belt 160 may be secured, so that the wire 1 can be prevented from twisting in the course of feeding the wire 1. The twisting of the wire 1 may mean that, in the case of the wire 1 being formed by twisting a plurality of fine wires, the wire 1 is rotated along a direction of twisting during feeding as the contact area with the configuration that feeds the wire 1. Hence, by securing the contact area between the belt 160 and the wire 1, rotating of the wire 1 may be prevented during feeding.

Figure 2:
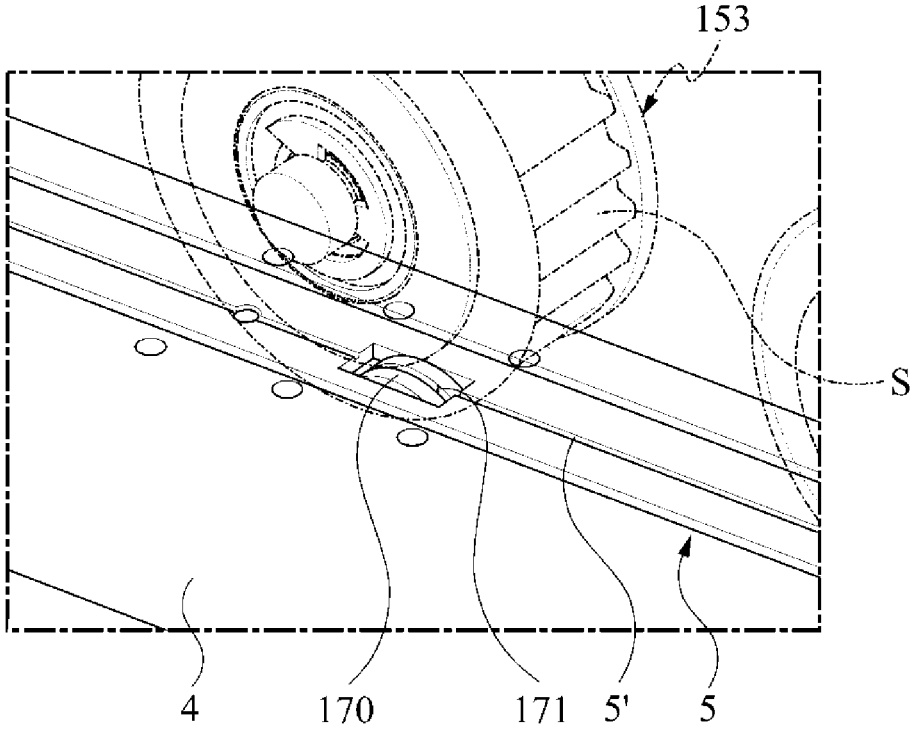
FIG. 2 is a perspective view illustrating an idler and a driven roller according to one embodiment of the present disclosure.
Figure 3:
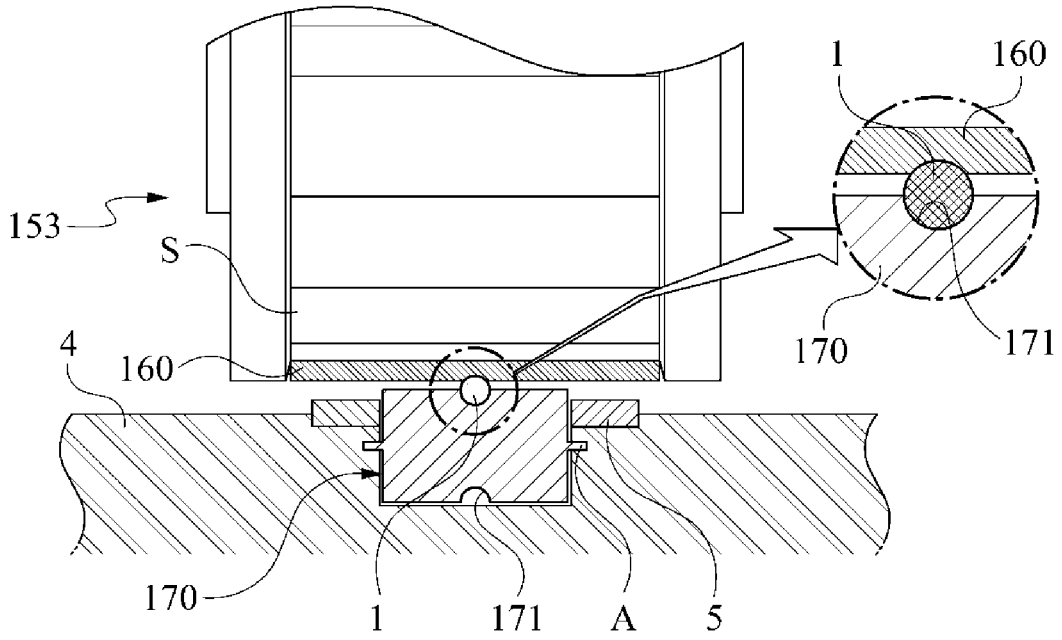
FIG. 3 is a cross-sectional view illustrating the idler and the driven roller according to one embodiment of the present disclosure.

FIG. 2 is a perspective view illustrating an idler 170 and a driven roller 153 according to one embodiment of the present disclosure, and FIG. 3 is a cross-sectional view illustrating the idler 170 and the driven roller 153 according to one embodiment of the present disclosure.

The third driven roller 153 among the driven rollers 151, 152, 153, 154 and 155 illustrated in FIG. 1 will be described with reference to FIG. 2. As described above, a number of idlers 170 may be provided corresponding to the number of driven rollers 151, 152, 153, 154 and 155, and the belt 160 may be interposed between each idler 170 and each driven roller 151, 152, 153, 154 and 155. A distance between the belt 160 and the idler 170 does not exceed a diameter of the wire 1 (when the wire is circular-shaped). In the course of pressurizing and feeding the wire 1, the idler 170 may be in a free-rotation state without being rotated and provided with separate power. For the free rotation, both ends of a rotation shaft A are connected to a base 4 and the idler 170 may be rotated about the rotation shaft A.

If the separate power is provided for the idler 170, the idler 170 has to be rotated at a rotational speed corresponding to a feeding speed determined by the rotational speed provided by the driving motor 120. In this case, when the rotational speed of the idler 170 does not correspond to the feeding speed of the belt 160 fed by the driving motor 120 and an error occurs, the wire 1 may slip during feeding and the amount or speed of wire 1 transferred to the head portion 3 may differ from information which is input in advance to the controller. The errors of the amount or speed of wire 1 bending or folding position of the wire 1 to be wrong. Thus, driving is performed by the single power source (driving motor 120) is used in order to avoid such possibility of error.

Meanwhile, referring to FIG. 3, the idler 170 has a guide groove 171 where the wire 1 can be seated to prevent the wire 1 from deviating in position in the course of feeding the wire 1. The guide groove 171 may be formed to correspond to a surface shape of the wire 1. For example, when the wire 1 has a diameter of 2 mm, a radius of the guide groove 171 may be formed as 1 mm, so that the shape of the guide groove 171 can correspond to the wire 1. The shape of the guide groove 171 may be determined to maximize a contact area with the wire 1 in order to prevent the wire 1 from slipping from the idler 170. The maximum value of the contact portion corresponds to half of the outer circumferential length of the wire 1, and the guide groove 171 may be provided that half of the outer circumference can be contacted.

Further, a surface of the guide groove 171 may be soft as the belt 160. The guide groove 171 having a predetermined elasticity may prevent slippage of the wire 1 through the surface friction. The guide groove 171 may be made of the same material as the soft belt to prevent slippage with the wire, or may be made of different material as the soft belt when the surface friction between the different material and wire 1 is formed higher than the surface friction between the metal material and the wire 1. A cover portion 5 may be disposed according to the arrangement of the plurality of driven rollers 151, 152, 153, 154 and 155. The cover portion 5 may be disposed on the base 4 and be positioned such that its maximum height from the base 4 is lower than the idler 170. This may be a structure for avoiding interference with the wire 1 to be fed and a loss of feeding power may be prevented by avoiding the interference with the wire 1.

Figure 4:
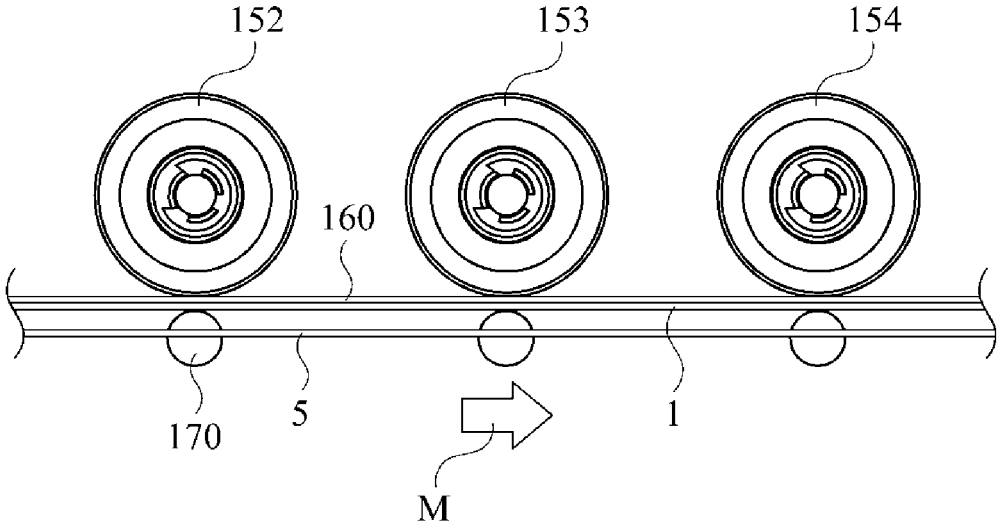
FIG. 4 is a side view illustrating the idler and the driven rollers according to one embodiment of the present disclosure.

FIG. 4 is a side view illustrating an idler 170 and driven rollers 152, 153 and 154 according to one embodiment of the present disclosure.

Referring to FIG. 4 in conjunction with FIG. 3, the cover portion 5 may have an auxiliary guide 5' formed in the form of a groove. The auxiliary guide 5' may be formed on an extension of the guide groove 171 formed on the idler 170 with respect to the feeding direction M of the wire 1. However, the auxiliary guide 5' does not guide the wire 1 in the conveying direction M through the continuous contact during the conveyance of the wire 1. When the wire 1 sags between the driven rollers 152, 153 and 154 or when the wire 1 deviates from some section, the auxiliary guide 5' performs a guide function such that the wire 1 can be normally fed to the next idler 170 (fed to the guide groove 171).

According to one embodiment of the present disclosure, a configuration which is in direct contact with a wire is limited to a belt and an idler to reduce a contact area, thereby reducing resistance to a feeding direction, and an increase in contact area through the belt prevents twisting that occurs in the course of feeding the wire and accordingly the resistance in the feeding direction is reduced so that a loss of power due to friction can be prevented.

In addition, according to one embodiment of the present disclosure, a feeding power generated by one driving motor is provided as a feeding force, wherein the wire is fed through the contact between a belt that rotates by the feeding power and a freely rotatable idler so that slippage due to a difference in feeding speed can be prevented.

Also, according to one embodiment of the present disclosure, a guide groove in which a part of wire can be seated is formed on the idler that is brought into contact with the wire so that the wire can be prevented from deviating in position and thus a wire feeding apparatus with higher reliability can be provided.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A wire feeding unit comprising:

a driving motor;

a driving roller which rotates by a driving force of the driving motor;

a plurality of driven rollers arranged such that outer circumferential surfaces thereof are positioned on a same line;

a belt that interlocks with the driving roller and the plurality of driven rollers, the belt configured to be brought into contact with a wire to be introduced to the wire feeding unit by being drawn into a side of the driven rollers;

a plurality of idlers configured to directly contact the wire while directly supporting the wire to be introduced to the wire feeding unit at a position where the wire contacts the belt and assist feeding of the wire along a feeding direction of the belt in a free-rotation state; and a cover portion having an auxiliary guide which is a groove configured to guide the wire to be introduced to the wire feeding unit in an auxiliary manner along an arrangement of the plurality of idlers, wherein each of the plurality of idlers has a guide groove formed on an outer circumferential surface thereof to allow the wire to be introduced to the wire feeding unit to be seated therein;

a depth of the guide groove is formed to be equal to a radius of the wire to be introduced to the wire feeding unit and a surface of the guide groove is in contact with a half of an outer circumferential surface of the wire;

the plurality of idlers are positioned so as to correspond to each of the plurality of driven rollers;

both ends of a rotation shaft of each idler are connected to a base; and the cover portion is disposed on the base and is positioned so that its maximum height from the base is lower than the maximum height of the plurality of idlers.

2. The wire feeding unit of claim 1, wherein the wire feeding unit is configured that a surface friction between the guide groove and the wire to be introduced to the wire feeding unit prevents the wire from escaping through surface friction over surface friction between a metal material of the idlers and the wire.

3. A wire bending apparatus comprising:

a wire inserter;

a wire feeding unit which is configured to feed a wire that is to be fed through the wire inserter; and a head portion which bends or folds the wire to be fed through the wire feeding unit, wherein the wire feeding unit comprises a driving motor;

a driving roller which rotates by a driving force of the driving motor;

a plurality of driven rollers arranged such that outer circumferential surfaces thereof are positioned on a same line;

a belt which interlocks the driving roller and the plurality of driven rollers and configured to be brought into contact with the wire, which is drawn into a side of the driven rollers, on a side of the plurality of driven rollers;

a plurality of idlers configured to directly support the wire on a side in which the wire and the belt are in contact with each other and configured to assist feeding of the wire along a feeding direction of the belt in a free-rotation state;

a cover portion having an auxiliary guide which is a groove configured to guide the wire to be introduced to the wire feeding unit in an auxiliary manner along an arrangement of the plurality of idlers, wherein each of the plurality of idlers has a guide groove formed on an outer circumferential surface thereof to allow the wire to be introduced to the wire feeding unit to be seated therein;

a depth of the guide groove is formed to be equal to a radius of the wire to be introduced to the wire feeding unit and a surface of the guide groove is in contact with a half of an outer circumferential surface of the wire;

the plurality of idlers are positioned so as to correspond to each of the plurality of driven rollers;

both ends of a rotation shaft of each idler are connected to a base; and the cover portion is disposed on the base and is positioned so that its maximum height from the base is lower than the maximum height of the plurality of idlers.

* * * * *